United States Patent [19]

Stemmle

[11] Patent Number: 4,786,042

[45] Date of Patent: Nov. 22, 1988

[54] ADJUSTABLE SIZE SENSING SHEET CASSETTE

[75] Inventor: Denis J. Stemmle, Webster, N.Y.

[73] Assignee: Xerox Corporation, Stamford, Conn.

[21] Appl. No.: 32,654

[22] Filed: Apr. 1, 1987

[51] Int. Cl.[4] ..... B65H 1/12

[52] U.S. Cl. ..... 271/9; 271/22; 271/127; 271/171; 271/255

[58] Field of Search ..... 271/255, 171, 22, 127, 271/164, 9

[56] References Cited

U.S. PATENT DOCUMENTS

| | | | |
|---|---|---|---|
| 3,406,964 | 10/1968 | Eichorn | 271/171 |
| 4,032,136 | 6/1977 | Komaba et al. | 271/160 |
| 4,174,103 | 11/1979 | Back et al. | 271/171 |
| 4,509,738 | 4/1985 | Aoki | 271/160 |
| 4,579,333 | 4/1986 | Aoki | 271/162 |
| 4,697,803 | 10/1987 | Kan | 271/127 |

FOREIGN PATENT DOCUMENTS

| | | | |
|---|---|---|---|
| 131642 | 8/1982 | Japan | 271/171 |
| 36037 | 2/1984 | Japan | 271/171 |
| 48834 | 3/1985 | Japan | 271/171 |
| 51424 | 3/1986 | Japan | 271/171 |

*Primary Examiner*—Richard A. Schacher

[57] ABSTRACT

An adjustable sheet cassette for use in apparatus feeding sheets such as in an automatic copier or printer comprises a sheet stack support platform capable of supporting stacks of sheets of a plurality of length and width dimensions, sheet width and length dimension representing members on the cassette, each independently movable to a plurality of positions representing a plurality of sheet width and length dimensions which are automatically positioned to represent the sheet width and sheet length dimensions of the stack of sheets on the platform with their position being detected by detectors on the main apparatus and a controller to determine the length and width dimensions of the copy sheets in the cassette thereby enabling the apparatus to automatically select the correct cassette to supply sheets for a printing operation. In a preferred embodiment a binary code is provided which represents the sheet length and width which is decoded by the controller.

35 Claims, 9 Drawing Sheets

ADJUSTABLE SIZE SENSING SHEET CASSETTE

The present invention relates to sheet feeding apparatus and in particular to a adjustable sheet feeding cassette capable of housing stacks of sheets for a printing operation.

BACKGROUND OF THE INVENTION

The present invention relates to sheet feeding apparatus and in particular to an adjustable sheet cassette capable of housing stacks of sheets or similar materials of different sizes.

In a particular application, the adjustable sheet cassette of the present invention has utility as a supply of stacked sheets in automatic printing apparatus such as reproducing apparatus including copiers, and electronic printers. Typically, in these devices, individual sheets of copy paper are separately fed through the copier and processed one at a time. In this process, it is convenient to have a supply stack of sheets from which to feed the individual sheets. Modern day business desires require that a copier or printer be capable of faithfully reproducing original documents of various sizes or configurations on various types of copy stock. To facilitate this operational flexibility, it has been customary to provide a supply of cut sheets in a cassette-type form. These paper sheet cassettes may be designed for a single fixed size of paper in which case they are only used for storing sheets of that size in the printing apparatus. Alternatively, adjustable cassettes may be designed to enable customer adjustment of the cassette for a variety of different sheet sizes. With the fixed size cassette if a printing operation is to be performed to obtain prints on a copy sheet size of a size other than that which is in the fixed cassette, the cassette must be removed from the machine and replaced with another cassette of a different fixed size to enable the operation to be completed. Similarly, with a adjustable adjustable cassette, if the size of the paper in the cassette is unsuitable for a particular printing operation, the copy sheets should be removed and replaced with the appropriate size copy sheets for that particular printing operation.

As a result of the use of different size copy sheets for different printing operations, it is becoming more customary to include a plurality of copy sheet sources in the printing apparatus which may be of different sizes from which the apparatus may automatically draw its copy sheet supply to perform any particular printing operation depending upon the size of the printing sheet desired. With such business printing desires, it becomes necessary that the printing apparatus know the size of the paper in each sheet supply location or cassette as soon as the cassette is inserted into the printing machine. There are several reasons why an automatic printing machine would require this information. For example, it enables the printing machine to automatically display the copy sheet size on the control panel to tell an operator a particular job can be run with the copy sheet size or to replace the copy sheet size. If the display does not automatically tell the operator, then the operator must gain access to the copy sheet supply to visually determine the size of the copy sheet supply. In addition, and with increasing sophistication in alternative capabilities in automatic printing machines, knowing the size of the copy sheets in any of the copy sheet supply locations in the automatic printing machine enables the automatic printing apparatus to select the appropriate size paper for size-to-size, automatic reduction and/or automatic enlargement of an original that may be placed on a copying platen. In addition, in some apparatus, the document feeder or sensors in the platen cover are capable of measuring the size of the document placed upon the imaging platen and selecting the correct size paper atomatically. If a copy sheet cassette is in the automatic printing machine and no size of the copy sheet in that cassette is determinable by the machine, the machine does not know if it has the appropriate size copy paper to match the size of the document being reproduced. Knowing the size of the copy sheets in each of the copy supply stations in an automatic printing machine enables the machine to automatically switch the sheet supplies thereby enabling, for example, in a long run of the same size copy paper, loading the same size paper in two sheet supply cassettes and when one supply is depleted, automatically switching to the other supply while the operator reloads the first supply. In addition in the automatic reduction and enlargement modes of operation, the automatic printing apparatus reads the size of the document and knows the degree of magnification desired by the operator. Knowing the size of the copy sheets in each of the copy supply stations enables the controller of the machine to calculate the closest paper size for the printing operation. Furthermore, if the automatic printing apparatus does not not know the size of the paper in the paper supply cassette and the apparatus is capable of scanning an original document placed on the imaging platen up to say 17" and only an 11" document is being copied, the scanning system does not known where to stop its scanning operation but rather scans the entire platen to capture the entire image. In addition to being inefficient in reducing the overall copy rate, this requires the use of more toner and more wear and tear on the machine. Accordingly, if the automatic printing apparatus can not automatically determine the copy sheet size, an operability difficulty is created in that the operator must gain access to the sheet supply in the apparatus to ensure that any particular printing operation may be performed. Thus by knowing the size of the copy sheets available in the printing apparatus, the printing apparatus can operate much more efficiently.

In prior art printing apparatus using sheet cassettes, several different techniques have been previously employed. Typically, for a fixed size sheet cassette such feature on the front of the cassette such as a rib, spring, magnet or button interacts with a bank of three or four sensors inside the copier to identify the size of the paper in the cassette. For customer adjustable cassettes, two different techniques have been used. In one, appropriate switches, wiring plugs, etc. are mounted into the cassette which after it is loaded into the automatic printing machine the operator must connect an electrical plug into the appropriate socket on the body of the automatic printing machine. This involves a complex operability difficulty and in addition is substantially more expensive than the fixed cassette approach. An additional technique used with the adjustable cassettes has been the use of the existing size sensing switches in the printing apparatus to have identified the cassette only as an adjustable cassette without identifying the size of the paper loaded. With this technique, the paper size in such a cassette will read "other" on the display panel on the control panel of the apparatus. While this technique has the advantage of lower cost, because the paper size is not known it tends to be useful only for unusual sizes of paper. In addition with this technique, the above-described automatic size, for size, reduction, enlargement and auto tray switching features must be disabled. As a result, customers typically purchase several fixed size cassettes for the common sizes of copy sheets that they will be using as well as an adjustable cassette for the miscellaneous odd sizes. This results in a large number of cassettes creating a storage problem as well as additional cost to the customer. The present invention is directed to a technique for identifying sheet sizes in an adjustable cassette by using switches which may already exist in the automatic printing machine and without requiring any switches, wires, plugs, etc. on the cassette itself which have to be plugged into the machine.

PRIOR ART

U.S. Pat. No. 4,032,136 to Komaba et al describes an adjustable copy sheet cassette which may be used with various sizes of copy sheets. The cassette comprises two separate inner plates for supporting a stack of copy sheets one of which is pivotable, the other of which is pivotable and biased upwardly by a spring to raise the copy sheets to the leading edge thereof. A side plate serves to position the copy mediums in accordance with the sizes thereof and is slidable with the inner plate along a guide plate. A limit plate is provided for positioning the copy mediums in accordance with the sizes thereof and is slidable on the other inner plate along a guide plate.

U.S. Pat. No. 4,174,103 to Back et al discloses a magazine for holding different sizes of sheet materials which is adjustable by the continuous displacement of three contact sides which involves the use of a cam disk and cam follower arrangement.

U.S. Pat. No. 4,509,738 to Aoki describes a paper feed cassette with a spring lift member and a paper pressure regulator. Different sizes of paper may be used with the spring lift member providing substantially equal and consistent paper pressure in each instance.

U.S. Pat. No. 4,579,333 to Aoki discloses a adjustable paper feed cassette which uses movement of guide plates to vary the scanning distance of an optical scanning system in accordance with the size of the recording paper. When the recording paper is of a small size, the scanning distance of the optical scanning system is shorter than when large size paper is used thereby improving reproduction efficiency. This is accomplished through the use of a rear or side guide plate which when moved for different size paper, mechanically moves an element such as a magnet which can be detected by the machine at one of several positions by means of a switch, for example, which can be used for varying the scanning distance of an optical scanning system. The device of Aoki is used only for adjusting the length of the optical scanning system by locating or positioning the switches or sensors in the same proportion as the paper size. It appears that there needs to be a switch or sensor required for each length of the various sheet sizes accommodated by the cassette.

SUMMARY OF THE INVENTION

In accordance with the present invention, a relatively inexpensive, adjustable sheet cassette adjustable to the sheet size of the copy sheets contained within the cassette which size may be readily determined by simple controller interrogation by the automatic printing apparatus is provided. More specifically, the present invention is directed to an adjustable sheet cassette comprising a sheet stack support platform capable of supporting stacks of sheets of a plurality of length and width dimensions, sheet width and length dimension representing members, each independently movable to a plurality of positions representing a plurality of sheet width and length dimensions, means to position the sheet width and length dimension representing members respectively to positions representing the sheet width and sheet length dimension of the stack of sheets on the support platform which position of the width and length dimension representing members is detectable by detectors on the printing apparatus. As used herein, the term stacks of sheets of a plurality of length and width dimensions is intended to refer to the dimensions of each sheet in the stack being the same, with the dimensions of each stack being different. Thus in any given stack the sheets are the same size and not of intermixed sizes.

It is a further aspect of the present invention to provide an adjustable adjustable sheet cassette for an automatic printing machine which is capable of automatic selection by the printing machine for printing operations requiring size for size reproduction, automatic reduction and enlargement, automatic tray selection, and automatic tray switching.

It is an additional aspect of the present invention to reduce the number of sheet cassettes required to provide a sheet supply of various sizes of sheets.

It is a further aspect of the present invention, that the sheet cassette includes a pair of side edge sheet guides in opposed relationship to each other, at least one of which is movable relative to the other, a movable rear edge sheet guide, the movable side and rear edge guides being adjustable to accommodate sheets of a plurality of width and length dimensions and means automatically responsive to movement of said movable side and rear edge guides to move said sheet width and length representing members to positions respectively representing a sheet width and a sheet length dimension.

In a further aspect of the present invention, the sheet width and length dimension representing members are encoding members which provide a unique binary code representing the sheet width and sheet length dimension of a stack of sheets on the platform.

In a further aspect of the present invention, the sheet length and the sheet width dimension representing members comprise pivotally mounted arms one end of which extends forward from the front of the cassette for detection by detectors in the printing apparatus.

In a further aspect of the present invention, the means automatically responsive to movement of the movable side and rear edge guide includes slidable bottom plates attached to each of said movable side edge sheet guide and rear edge sheet guide each plate having a cam surface therein and wherein the pivotally mounted arms have locating members attached thereto in cooperation with the cam surface wherein when the position of the movable guides is altered, the position of the dimension representing members may be correspondingly altered by pivoting about a pivot point in response to movement of the locating member by following the cam surface.

In a further aspect of the present invention, the automatic printing apparatus includes control means to determine the length and width dimensions of a copy sheet in the cassette from the detected respective position of the sheet width and length representing members to enable the apparatus to automatically select the cassette supply of sheets for a printing apparatus.

In a further aspect of the present invention, the detector and control means on the apparatus are the same detector and control to determine the size of sheets in a fixed size sheet cassette.

It is a further aspect of the present invention in that the detector comprises a plurality of spaced individual detectors fixed to the apparatus which send a signal to the control means when the presence of the width and length dimension representing members are detected by the individual detectors.

For a better understanding of the invention as well as other objects and further features thereof, reference is had to the following drawings and description:

DESCRIPTION OF THE PREFERRED EMBODIMENT

The invention will now be described by reference to a preferred embodiment.

Figure 2:
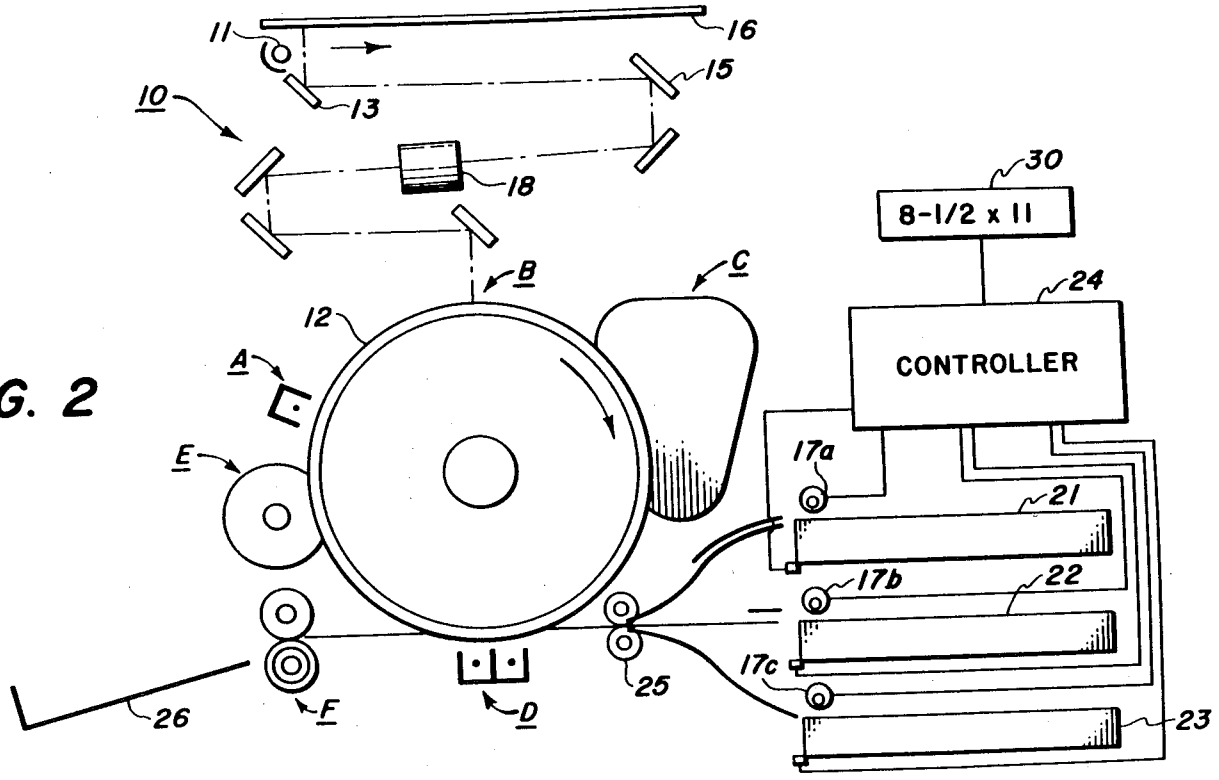
FIG. 2 is a schematic representation of an automatic printing machine having a plurality of copy sheet supplies at least one which may be the adjustable sheet cassette of the present invention.

Referring initially to FIG. 2, there is shown an automatic xerographic printing machine 10 including three copy sheet supply sources 21, 22, 23 at least one of which 21 comprises the adjustable sheet cassette according to the present invention. Although the present invention is particularly well suited for use in automatic xerographic apparatus, it is equally well adapted for use with any number of other devices in which cut sheets of material are fed from a sheet supply source. The printer includes a photosensitive drum 12 which is rotated in the direction indicated by the arrow to pass sequentially through a series of xerographic processing stations; a charging station A, an imaging station B, a developer station C, a transfer station D and a cleaning station E.

A document to be reproduced is placed on imaging platen 16 and scanned by moving optical system including a lamp 11 and mirrors 13 and 15 and stationary lens 18 to produce a flowing light image on the drum surface which had been charged at charging station A. The image is then developed at development station C to form a visible toner image. As illustrated, three supplies of cut sheets are available in the sheet supply trays 21, 22 and 23, with tray 21 comprising the adjustable sheet cassette according to the present invention. Each of the trays may be actuated by the controller 24 to feed a sheet therefrom by actuating the appropriate segmented sheet feed roll 17*a*, 17*b*, or 17*c* to feed a sheet to registration rolls 25 in synchronous relationship with the image on the drum surface to the transfer station D. Following transfer of the toner image to the copy sheet, the copy sheet is stripped from the drum surface and directed to the fusing station F to fuse the toner image on the copy sheet after which the drum surface itself continues the cleaning station E where residual toner remaining on the drum surface is removed prior to the drum surface again being charged at charging station A. Upon leaving the fuser, the copy sheet with the fixed toner image thereon is transported to sheet collecting tray 26.

The practice of xerography is well known in the art and is the subject of numerous patents and texts including Electrophotography by Schaeffert and Xerography and Related Processes by Dessauer and Clark, both published in 1965 by Focal Press.

As previously indicated, any or all of sheet supply trays 21, 22, and 23 may be the adjustable sheet cassette according to the present invention or alternatively, trays 22 or 23 may be fixed size sheet cassettes or sheet supply trays which are permanent parts of the main printing apparatus.

Figure 3:
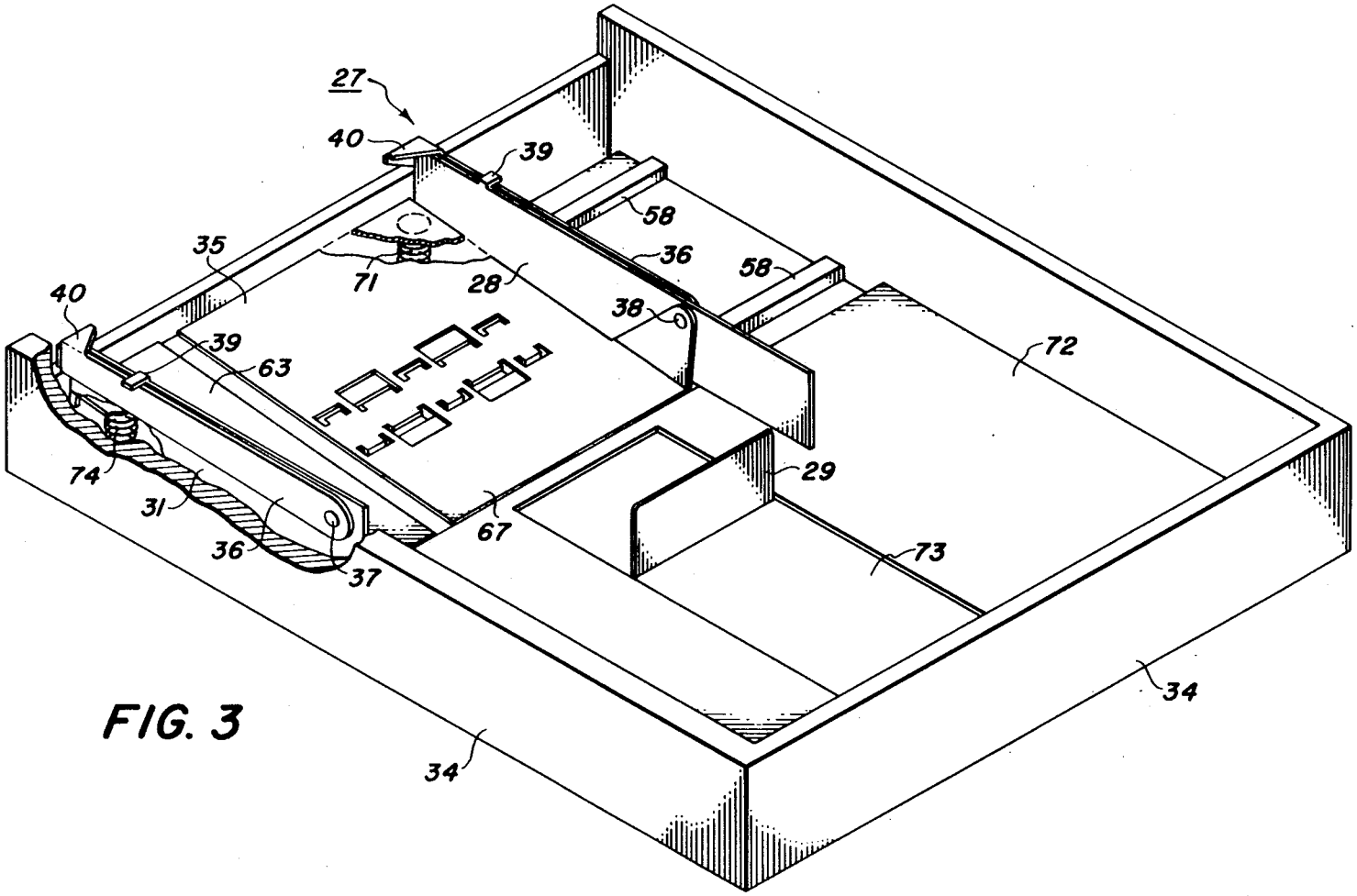
FIG. 3 is an isometric view of the adjustable sheet cassette of the present invention with the cover removed showing the two-part sheet support platform and its support mechanism.

Referring more particularly to FIGS. 1, and 3 through 7 wherein the adjustable sheet cassette, and in particular the size sensing capabilities of the cassette will be described in greater detail. With particular reference to FIG. 3, the general appearance of the adjustable cassette may be observed with the top cover of the cassette having been removed. The sheet stack dimensions of the sheet holding cassette may be adjustable through positioning movable side edge sheet guide 28 and rear edge sheet guide 29. It should be noted that the cassette 27 is slidingly mountable on a pair of guide rails on the main printing apparatus as it is inserted into the sheet supply cavity from the side of the copying machine. The guide rails are each mounted at opposite ends to parallel apparatus frame members and the cassette is inserted until the stop member on the guide rail interrupts further travel of the cassette onto the guide rails by engaging the stop member of the cassette.

The cassettes generally comprise a box-like configuration with the sheet holding cavity in the center surrounded by walls 34, it being noted that the height of the front wall is generally lower than the remaining walls to enable feeding a sheet thereover. As will be described in greater detail hereinafter the sheet stack supply platform 35 is urged upwardly by spring means so that the sheet supply is raised above the height of the forward wall 34 at the front of the cassette. The fixed side edge sheet guide 31 and movable side edge sheet guide 28 each have arms 36 pivotally mounted to the rear thereof about pivot points 37, 38 with corner snubbers 40 on the other end of the arms. These snubbers are arranged to ride on the corners of a stack of sheets inhibiting the forward motion of the corners of the sheets when the sheet is fed in the forward position. Since the vertical range of the snubber arms 36 is inhibited by stop member 39. The snubbers also inhibit upward motion of the stack of sheets to position the top sheet of a stack in correct position for feeding and to keep the spring from biasing the stack against feed rolls when not feeding. Accordingly, the sheet stack on the support platform 35 is upwardly biased by a spring so that the top sheet on the sheet stack support platform is brought into feeding engagement with the feeding mechanism which may be the segmented feed roll 17*a*, 17*b*, or 17*c* as illustrated in FIG. 2.

Figure 1:
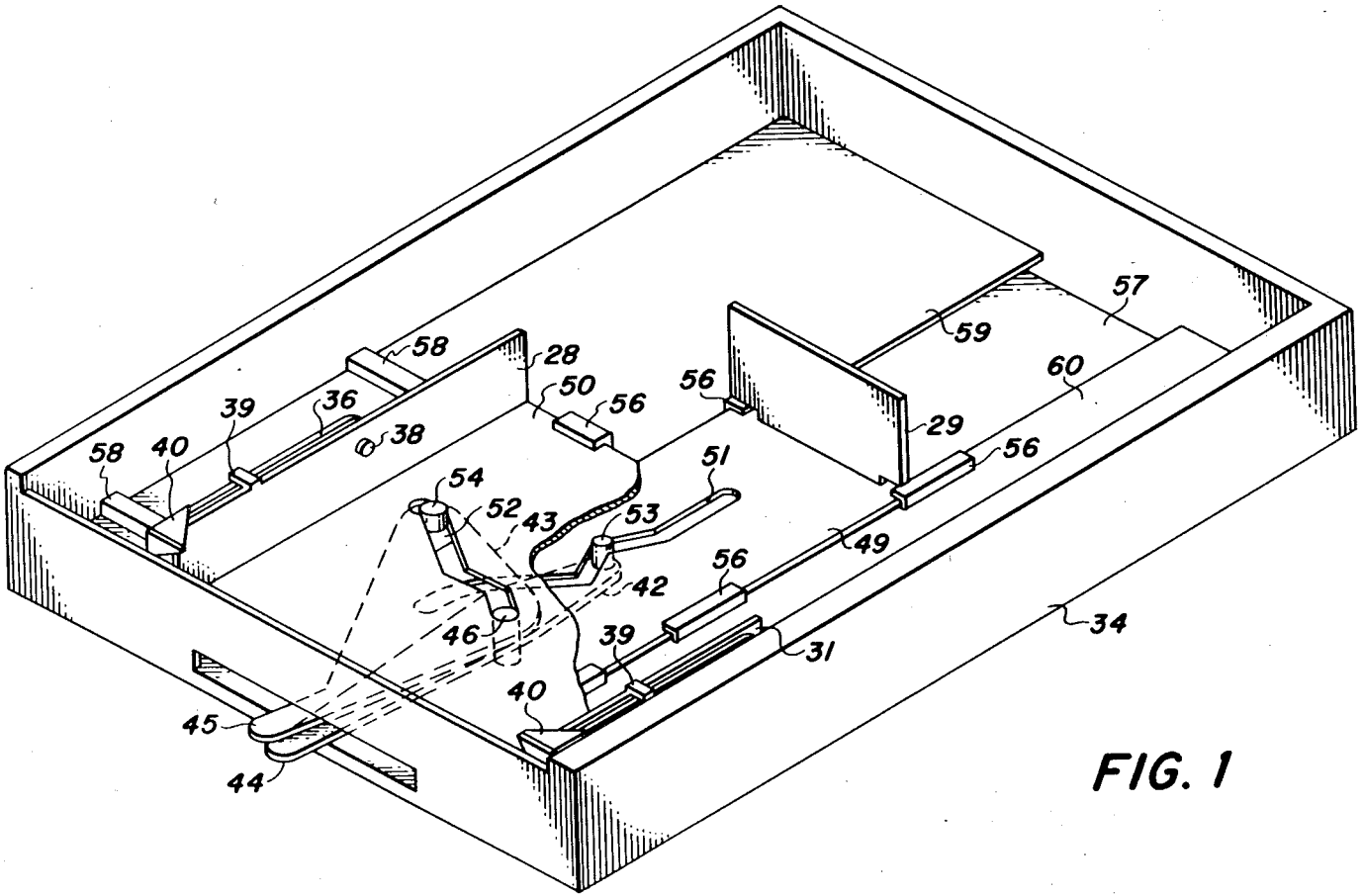
FIG. 1 is an isometric view of the adjustable sheet cassette of the present invention with the sheet stack support platform removed illustrating the mechanism for positioning the width and length dimension representing members.
Figure 4:
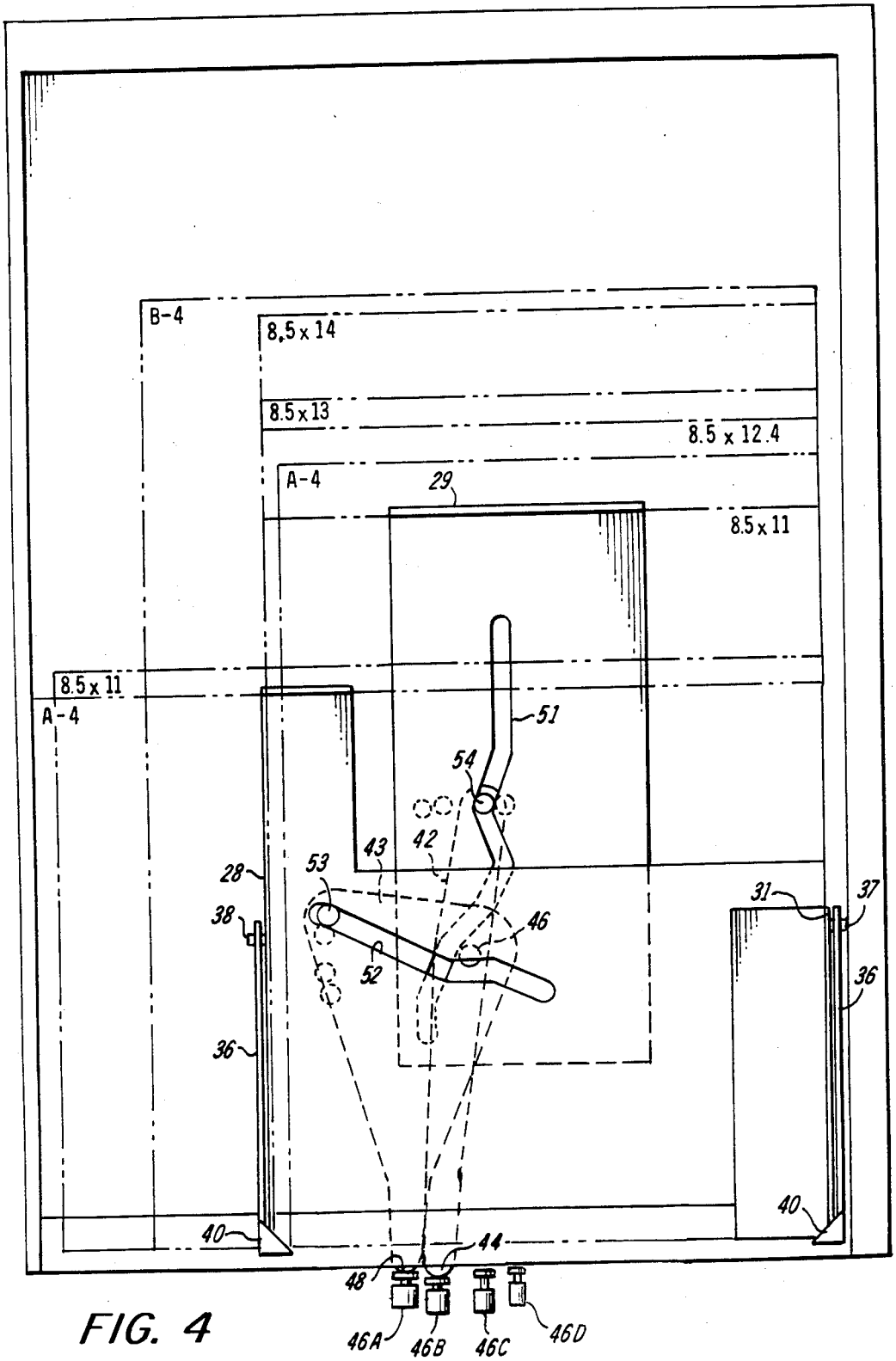
FIG. 4 is a top view of the adjustable sheet cassette of the present invention with the sheet support platform removed illustrating different positions of the width and length dimension representing members corresponding to different size sheets.

The size sensing mechanism and the operation thereof will be described in further detail with particular reference to FIGS. 1 and 4. The mechanism is quite simple being based on the use of two linkages which are added to both the movable side edge sheet guide and the rear edge sheet guide which pivot as the guides are adjusted. A portion of each of the linkages protrudes out the front of the cassette and depresses existing switches on the main body of the printing apparatus when the cassette is inserted into the copier. By determining which switch has been depressed, the printing machine logic can determine the position of both the movable side edge guide and the rear edge guide and thereby determine the copy sheet size (both length and width dimensions) in the adjustable adjustable cassette. In this regard, it should be noted that the same switch codes as are used for the adjustable cassette may also be used for fixed cassettes and accordingly, the printing apparatus cannot distinguish between fixed and the adjustable cassette. The length and width dimension representing members comprise pivotally mounted arms 42 and 43 respectively representing the positions of the length and width dimensions of the copy sheets contained within the adjustable cassette. Each of the pivotally mounted arms 42 and 43 has a respective end portions 44 and 45 which extends forward from the front of the cassette to engage switches 46*a*, 46*b*, 46*c* and 46*d* on the main body of the printing apparatus. The pivotal arms 42 and 43 are pivotally mounted about a fixed pivot 46 on the cassette base 47 (see FIG. 6). The position of the length and width arm end portions 44 and 45 is determined by the position of the movable side and rear edge guide 28 and 29 in the following manner. The movable side edge sheet guide and rear edge sheet guide 28 and 29 respectively are fastened to slidable bottom plates 50 and 49 respectively which are movable. Each of the plates 49 and 50 have a cam slot 51 and 52 respectively in which locating pins 53 and 54 are positioned. The locating pins and 53 and 54 are fixedly attached to pivotal arms 42 and 43. Accordingly therefore, as the movable rear edge sheet guide 29 is moved forward, slidble bottom plate 49 is moved forward with it and the cam slot 51 locates the position of the locating pin 53 thereby pivoting the pivot arm 42 about the fixed pivot 46 to position arm end portion 44. Attention is particularly directed to FIG. 4 to illustrate four locations in dotted line circles of the locating pins 53 and 54 which represent the width and length dimensions as illustrated in the FIGURE. Accordingly, by adjusting the location of locating pins 53 and 54, the arm ends 45 and 44 of the pivotal arms are moved to positions engaging switches 46*a* through 46*d*. In this regard, it should be noted that the shape of each cam slot may be readily determined by selecting a combination of switch positions for a combination of particular sheet dimensions, placing the pivotal arm ends at those switch positions and determining the positions of the fixed locating pins on the pivotable arms with respect to the slidable bottom plates in the correct position for the sheet size and marking the bottom plates with the locations. After all positions of the pivotable arm ends and the locating pins on the bottom plate have been determined, the curve can be drawn between the positions. A plurality of bottom plate guides 56 attached to fixed bottom plates 59 and 60 are provided to ensure accurate location of both the length and width slidable bottom plates and thereby both the side edge sheet guide and the rear edge sheet guide in the cassette. The length slidable bottom plate 49 is slidable along support member 57 and the width slidable bottom plate is slidable along support rails 58.

Figure 3A:
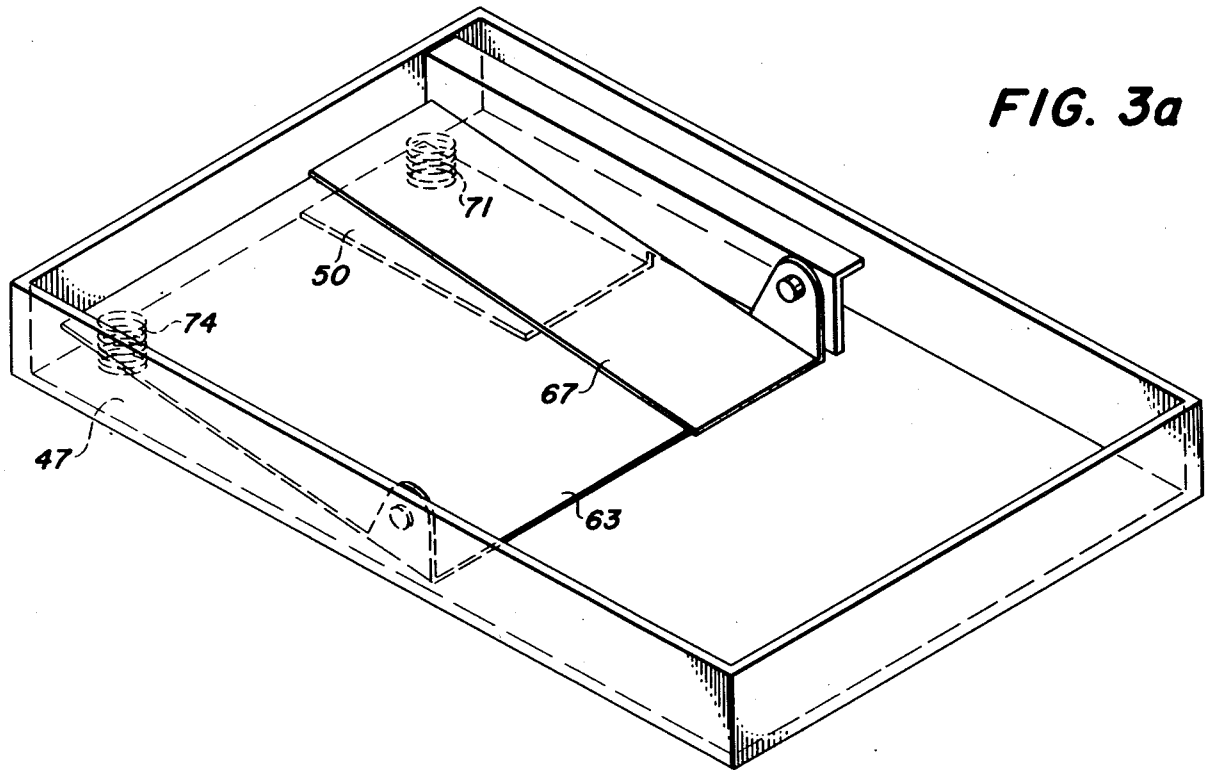
FIG. 3*a* illustrates the support mechanism in somewhat greater detail.
Figure 5:
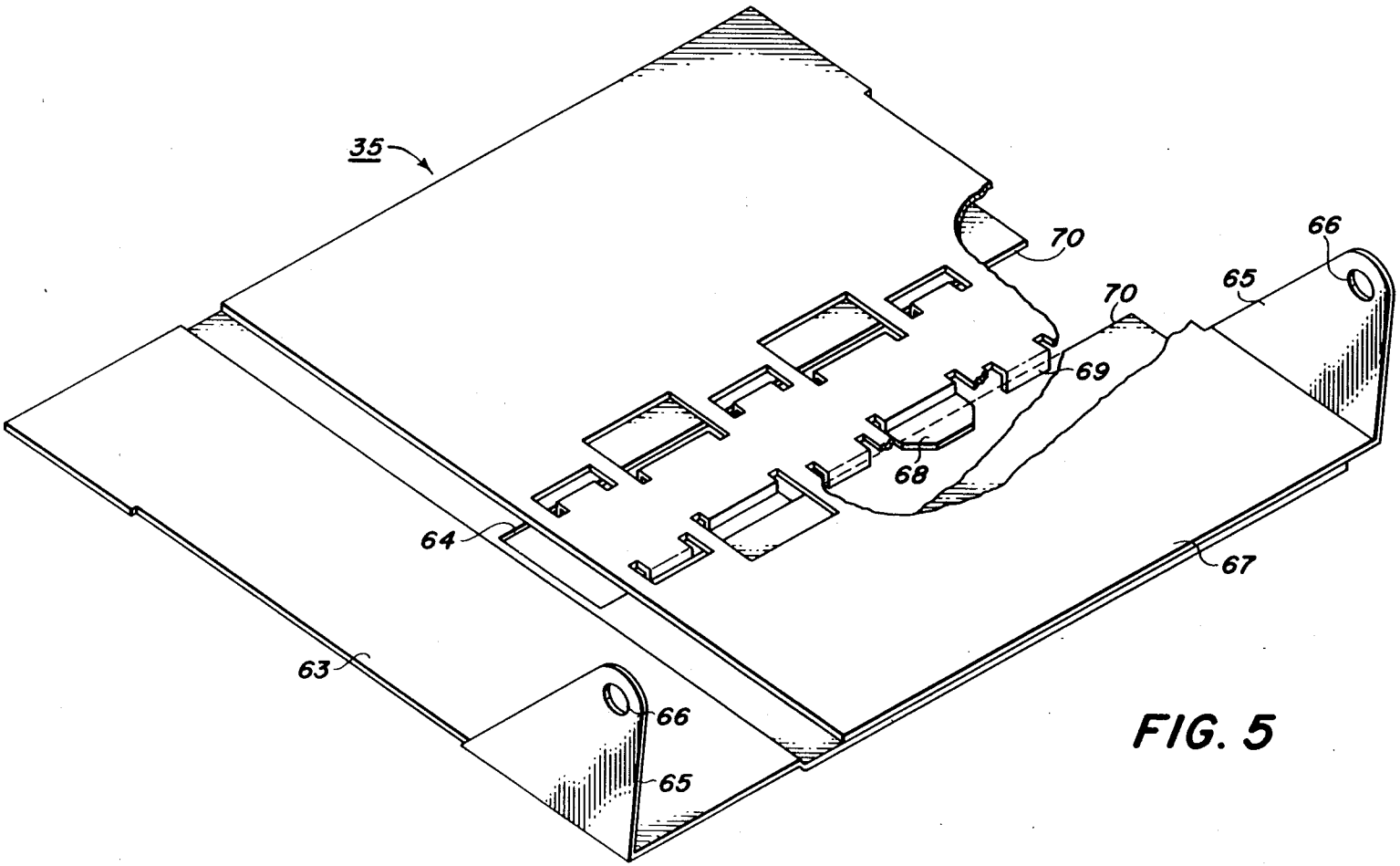
FIG. 5 is an enlarged isometric view of the sheet support platform showing a slidable member with a portion cut away.
Figure 6:
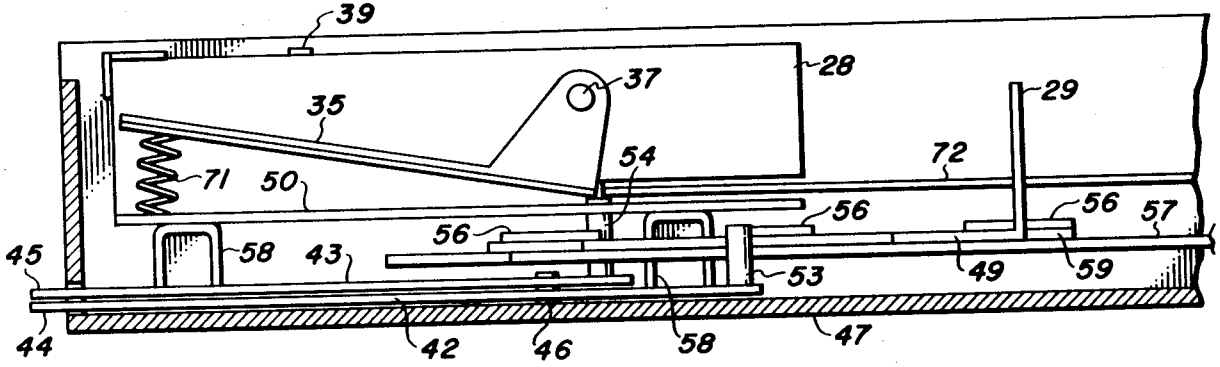
FIG. 6 is a side view of the adjustable sheet cassette illustrating the respective positions of the dimensions representing members support platform and other elements of the device.
Figure 7:
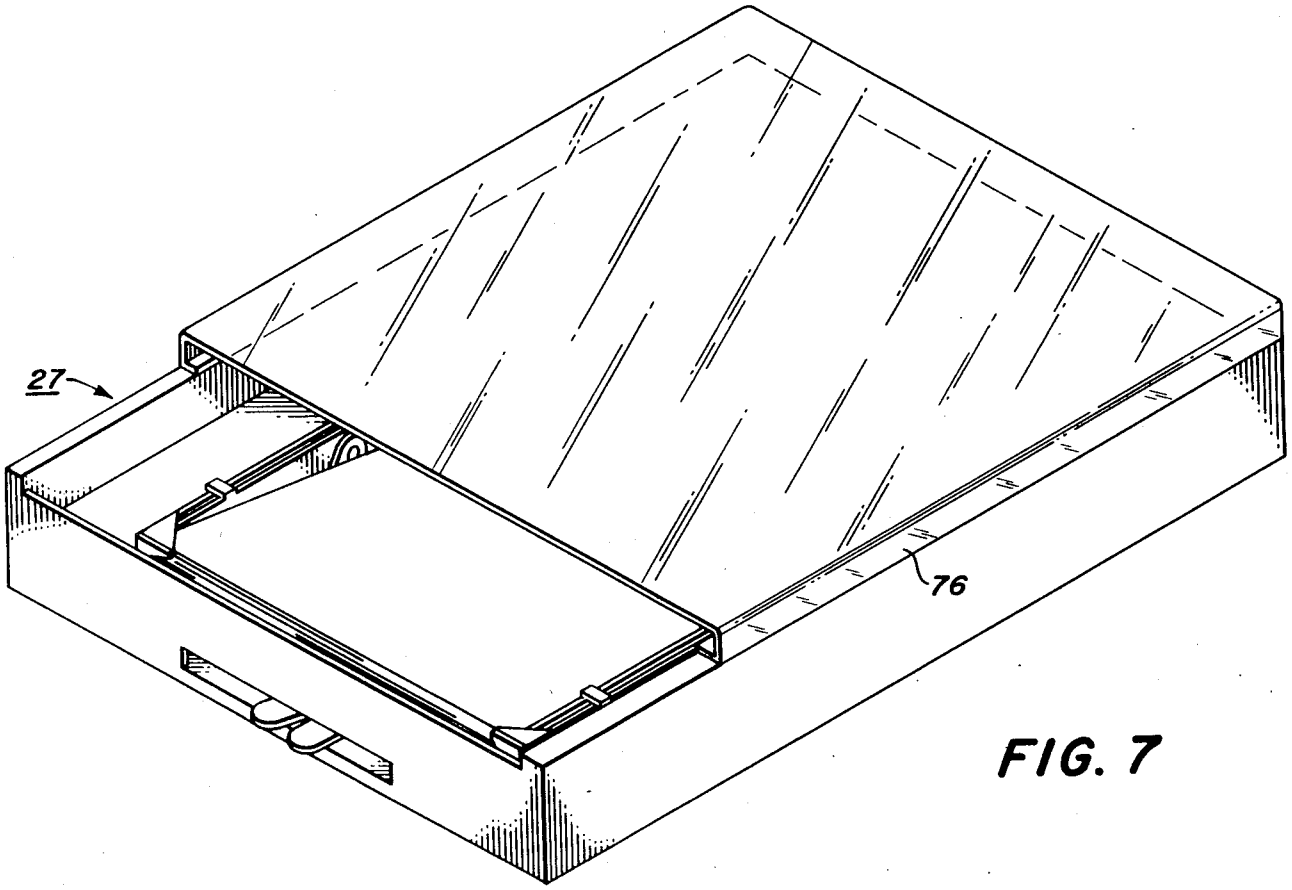
FIG. 7 is an isometric view of the adjustable sheet cassette with the cover 76 in place.

With continued reference to FIG. 3, and additional reference to FIG. 5, the sheet stack support platform will be described in greater detail. The sheet stack support platform 35 comprises a fixed sheet support portion 63 and a slidable or adjustable sheet support portion 67. Sheet support portion 63 has a slot 64 contained therein for adjustable sliding engagement with slidable portion 67 which has slide guides 68 and abutment members 69 therein to engage the edges 70 of the slot 64. The sheet stack support platform members are mounted through holes 66 to pivot points 37 and 38 on the fixed side edge guide 31 and the movable side edge guide 28 respectively which are supported by flanges 65. As illustrated in FIGS. 3, 3*a* and 6, the sheet stack support platform is spring biased upwardly by means of springs 71 and 74, springs 71 being supported by the bottom plate 50 upwardly biasing the slidable portion 67 of the sheet stack support platform and the spring 74 being supported by the cassette base 47 and upwardly biasing the fixed portion 63 of the sheet stack support platform so that the top of a stack of sheets contained within the sheet support platform is upwardly biased into engagement with snubbers 40. As illustrated, the sheet stack support platform need not be as deep or as long as the sheet to be fed but rather may be somewhat shorter having a fixed rear sheet support member 72 to the rear thereof and at the same level as the rear of the sheet support platform which has a rear guide slot 73 therein to accommodate adjustment of the movable rear edge sheet guide 29.

In operation, the adjustable adjustable cassette will, for example, have the movable side edge sheet guide 28 and the movable rear edge guide 29 withdrawn to their largest dimension as a stack of sheets to be placed in the cassette is placed against the fixed side edge sheet guide 31 with the leading edge of the sheets under the snubbers 40. The movable side edge sheet guide 28 and rear edge sheet guide 29 are then moved into position adjacent the side edge and rear edge of a stack of sheets on the sheet stack support platform. As the movable side edge and rear edge guides are moved into position, the slidable width and length bottom plates 50 and 49 respectively are moved thus altering the location of cam slots 51 and 52 which alter the positions of locating pins 53 and 54 thus altering the position of arm ends 45 and 44. When adjustment of the movable side edge and movable rear edge sheet guides is completed, the cassette is inserted into the machine until it abuts a stop member at the forwardmost location of the cassette within the machine at which time the arm ends 44 and 45 come into the appropriate engagement with switches 46*a* through 46*d*. When the switches are closed, a signal is sent to the controller 24 of the machine which provides the appropriate display of the size of sheets on the display 30 on the control panel of the machine. At this time, the controller 24 has determined the size of the sheets in the adjustable cassette and with conventional logic may select the adjustable cassette as the source for copy sheets in any particular printing operation. Accordingly, the printing machine may be able to automatically select the sheet in the adjustable cassette if it determines after measuring the size of the document under the platen, that it is the appropriate size copy sheet for the printing operation. Alternatively, it may quickly select the sheets in the adjustable cassette if they are appropriate for a particular reduction or enlargement printing operation. In additon, it may automatically switch to the adjustable cassette for the supply of sheets in a printing operation after the initial supply of sheets in another paper source has been depleted.

The length and width dimension representing members, the pivoting arms, may directly provide a unique position for each arm representing each length or width dimension which positions are detected by sensors on the main apparatus. This may be accomplished by having two banks of sensors in the apparatus, one for length dimension and one for width dimension, wherein one sensor is provided for each discrete position of the pivoting arms for each length or width dimension. Such a system is expensive in accommodating a large range of sheet sizes because of the number of sensors required. According to a preferred embodiment of the present invention, the positions of the pivoting arms form a unique binary code which can be read by the controller and decoded to determine a unique combination of a length and a width of sheets in the cassette. As a result of using a binary code, neither of the positions of the pivoting arms needs to directly correlate (though it may) to not directly represent (though it may) the position of the side or rear guides. The pivoting arms therefore become encoding members and represent indirectly the sheet width and length through the binary code formed by the position of both pivoting arms which represents a unique combination of the length and width of the sheets in the cassette. It is not the positions of the arms that represent the sheet length and width dimensions but rather the binary code formed by the positions of both pivoting arms which represent a unique combination of length and width taken together.

This may be illustrated with reference to FIG. 4 and the Tables below in which four switch positions can be used to determine any of eight different sheet sizes or orientations. In Table I, S refers to the arm end connected to the side edge sheet guide, R refers to the arm end connected to the rear edge sheet guide, SEF refers to short edge feed, and LEF refers to long edge feed. As illustrated in the Tables, it should be understood that the switch positions may be occupied by both the arm ends of the side edge and the rear edge sheet guides.

TABLE 1

| | 46d | 46c | 46b | 46a |
|---|---|---|---|---|
| A4 SEF | | | | SR |
| 8½ × 11 SEF | | | R | S |
| 8½ × 12.4 | | | SR | |
| 8½ × 13 | | R | S | |
| 8½ × 14 | R | | S | |
| B4 | R | S | | |
| 11 × 8½ LEF | | S | | R |
| A4 LEF | S | | | R |

This may be translated to the following binary code:

TABLE II

| | 46d | 46c | 46b | 46a |
|---|---|---|---|---|
| A4 SEF | 0 | 0 | 0 | 1 |
| 8½ × 11 SEF | 0 | 0 | 1 | 1 |
| 8½ × 12.4 | 0 | 0 | 1 | 0 |
| 8½ × 13 | 0 | 1 | 1 | 0 |
| 8½ × 14 | 1 | 0 | 1 | 0 |
| B4 | 1 | 1 | 0 | 0 |
| 11 × 8½ LEF | 0 | 1 | 0 | 1 |
| A4 LEF | 1 | 0 | 0 | 1 |

which can be decoded by the controller to determine sheet size in the cassette both length and width. Other codes of unique sizes are possible though not here illustrated. Accordingly, as illustrated in TABLE I, the pivoting arm associated with the rear edge guide will close switch **46*a* for three different sheet length dimensions while the arm associated with the side guide is at three unique switches 46*a*, 46*c* and 46*d*.** As a result at least ten unique paper sizes both width and length may be detected by only four sensors. If desired more or less than four sensors may be used with more or fewer unique lengths and widths detectable.

Figure 8:
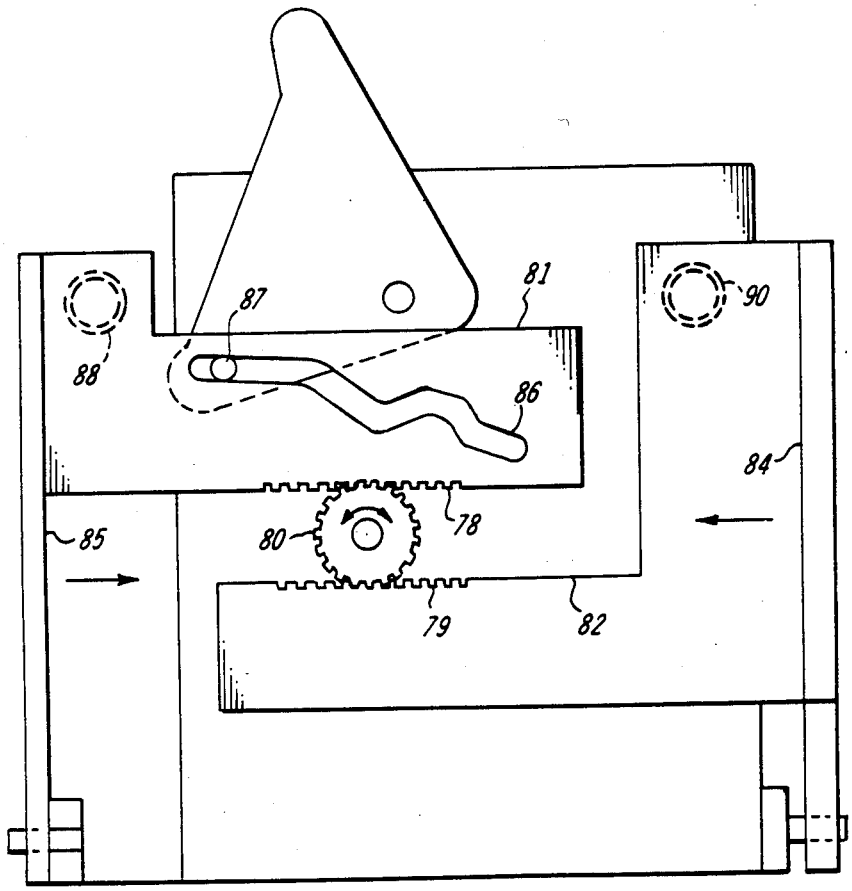
FIG. 8 is a top view of an alternative embodiment of the adjustable sheet cassette wherein both side edge guides are movable.

FIG. 8 is a top view with the sheet support platform illustrating an alternative embodiment wherein both side edge sheet guides are movable through the use of two movable racks 78, 79 in operative association with a stationary pinion 80 therebetween. The racks are on opposed sides of two slidable bottom plates 81 and 82 having fixed thereto side edge guides 84 and 85. As one edge guide is manually moved to adjust for different size paper it transmits a driving action to the other edge guide in the opposite direction thereby providing a center registration of the stacks of sheets. One of the slidable bottom plates 81 has cam slots 86 therein for cooperation with the locating pin 87 and pivoting arms in the manner previously described. It will be understood that the construction and operation of the movable rear edge guide is the same as previously illustrated. It should also be noted that both portions of the sheet stack support platform will be supported by springs 88 and 90 which are attached to the two sliding bottom plates.

The patents and text referred to specifically in this application are hereby incorporated herein by reference in their entirety into present application.

Thus, according to the present invention, a simple, low cost adjustable sheet cassette with no electrical connections is provided. In addition, this cassette has the advantage of being interchangeable with a single size fixed cassette which may employ similar devices to enable the printing machines to automatically determine the size of the sheet in the sheet supply source. While the adjustable cassette has been described with particular reference to a xerographic copying apparatus, it will be understood that it has equal application to other types of printing devices including xerographic printers or other apparatus designed to make marks directly on paper. Furthermore, while the invention has been described with regard to detectors comprising switches it will be understood that optical sensors and magnetic sensors may also be used. While it has been illustrated as having four detectors or switches, it will also be understood that any number of such switches can be used determined by the number of different sizes of sheets that it is desired to use. Furthermore, while the adjustable cassette has been illustrated as capable of being used with a segmented feed roll, it will be understood that any forward, reverse or retard feeder may be employed. Accordingly, it is intended to embrace all such alternatives and modifications as may fall within the spirit and scope of the appended claims.

I claim:

1. An adjustable sheet cassette for use in apparatus feeding sheets therefrom comprising a sheet stack support platform, said platform being capable of supporting stacks of sheets of a plurality of length and width dimensions, sheet width and length dimension representing members each independently movable to a plurality of positions representing a plurality of sheet width and length dimensions, a pair of side edge sheet guides in opposed relationship to each other at least one of said side edge sheet guides being movable relative to the other side edge sheet guide, a movable rear edge sheet guide, said at least one movable side and rear edge guides being adjustable to accommodate stacks of sheets of a plurality of width and length dimensions and means automatically responsive to movement of said at least one movable side and rear edge guides respectively to move said sheet width and length representing members to positions respectively representing a sheet width and a sheet length dimension of the stack of sheets on the platform, the position of said width and length dimension representing members being detectable by detector means on said apparatus.

2. The sheet cassette of claim 1 wherein said sheet length and sheet width dimension representing members comprise pivotally mounted arms one end of which extends forward from the front of said casssette for detection by detector means on said apparatus.

3. The sheet cassette of claim 2 wherein said sheet length and sheet width dimension representing arms pivot about the same fixed point.

4. The sheet cassette of claim 3 wherein said means automatically responsive comprises slidable bottom plates fixedly attached to each of said at least one movable side edge sheet guide and said movable rear edge sheet guide, each said bottom plate having a cam surface, each of said pivotally mounted arms having a locating member attached thereto spaced from said fixed pivot point in cooperative association with said cam surface whereby when the position of each of said movable guides is altered the position of the dimension representing member may be correspondingly altered by pivoting about said pivot point in response to movement of the locating member by following said cam surface.

5. The sheet cassette of claim 4 wherein said cam surfaces comprise slots in said slidable bottom plates and said locating members on said pivotally mounted arms comprise locating pins in said slots.

6. The sheet cassette of claim 1 wherein said sheet support platform comprises two sheet support plates slidably engageable with each other, one of said support plates being pivotally mounted about its rear portion to said fixed side edge guide, the other of said support plates being pivotally mounted about its rear portion to said movable side edge guide whereby said sheet support plates provide a sheet support platform of different sizes corresponding to the position of said movable side edge guide.

7. The sheet cassette of claim 6 further including means to upwardly bias the front portion of said sheet support plates.

8. The sheet cassette of claim 7 wherein said sheet support plate attached to said fixed side edge guide is upwardly biased by a spring anchored to the base of said cassette and said sheet support plate attached to said movable side edge guide is upwardly biased by a spring anchored to said slidable bottom plate attached to said movable side edge sheet guide.

9. The sheet cassette of claim 4 further including guide means for each of said slidable bottom plates.

10. The sheet cassette of claim 1 wherein one of said side edge sheet guides is fixed.

11. The sheet cassette of claim 1 wherein both of said side edge sheet guides are movable.

12. The sheet cassette of claim 1 wherein said sheet width and length dimension representing members are encoding members for a binary code, said encoding members representing a plurality of sheet width and length dimensions codes and being positioned by said positioning means to positions providing a unique binary code representing the sheet width and sheet length dimension of the stack of sheets on the platform, said binary code being detectable by detector means on said apparatus.

13. The sheet cassette of claim 12 wherein said means to position said sheet width and length dimension encoding members comprises a pair of side edge sheet guides in opposed relationship to each other, at least one of said side edge sheet guides being movable relative to the other side edge sheet guide, a movable rear edge sheet guide, said at least one movable side and rear edge guides being adjustable to accommodate stacks of sheets of a plurality of width and length dimensions and means automatically responsive to movement of said at least one movable side and rear edge guides respectively to move said sheet width and length dimension encoding members to positions respectively providing a binary code representing a sheet width and a sheet length dimension.

14. The sheet cassette of claim 13 wherein said sheet length and sheet width dimension encoding members comprise pivotally mounted arms one end of which extends toward the front of said cassette for detection by detector means on said apparatus.

15. The sheet cassette of claim 14 wherein said sheet length and sheet width dimension encoding arms pivot about the same fixed point.

16. The sheet cassette of claim 15 wherein said means automatically responsive comprises slidable bottom plates fixedly attached to each of said at least one movable side edge sheet guide and said movable rear edge sheet guide, each said bottom plate having a cam surface, each of said pivotally mounted arms having a locating member attached thereto spaced from said fixed pivot point in cooperative association with said cam surface whereby when the position of each of said movable guides is altered the position of the dimension encoding member may be correspondingly altered by pivoting about said pivot point in response to movement of the locating member by following said cam surface.

17. The sheet cassette of claim 16 wherein said cam surface comprises slots in said slidable bottom plates and said locating members on said pivotally mounted arms comprise locating pins in said slots.

18. Automatic printing apparatus including a station for printing an image on a sheet, means for supporting a removable, adjustable sheet cassette containing sheets in a cooperative position in said apparatus, means for feeding a sheet from said adjustable sheet cassette to said printing station, said apparatus including at least one other supply of sheets, said adjustable cassette comprising a sheet stack support platform, said platform being capable of supporting various stacks of sheets of a plurality of length and width dimensions, sheet width and length dimension representing members each independently movable to a plurality of positions representing a plurality of sheet width and length dimensions, a pair of side edge sheet guides in opposed relationship to each other at least one of said side edge sheet guides being movable relative to the other side edge sheet guide, a movable rear edge sheet guide, said at least one movable side and rear edge guides being adjustable to accommodate various stacks of sheets of a plurality of width and length dimensions and means automatically responsive to movement of said at least one movable side and rear edge guides respectively to move said sheet width and length representing members to positions respectively representing a sheet width and a sheet length dimension of the stack of sheets on the platform, the position of said width and length dimension representing members being detectable by detector means on said apparatus, said apparatus including detector means to detect the respective positions of said sheet width and length representing members, said apparatus further including control means to determine the length and width dimensions of a copy sheet in said cassette from the detected respective positions of said sheet width and length dimension representing members to enable said apparatus to automatically select said sheet cassette to supply sheets for a printing operation.

19. The printing apparatus of claim 18 wherein said sheet length and sheet width dimension representing members comprise pivotally mounted arms one end of which extends forward from the front of said cassette for detection by said detector means on said apparatus.

20. The printing apparatus of claim 19 wherein said sheet length and sheet width dimension representing arms pivot about the same fixed point.

21. The printing apparatus of claim 20 wherein said means automatically responsive comprises slidable bottom plates fixedly attached to each of said at least one movable side edge sheet guide and said movable rear edge sheet guide, each said bottom plate having a cam surface, each of said pivotally mounted arms having a locating member attached thereto spaced from said fixed pivot point in cooperative association with said cam surface whereby when the position of each of said movable guides is altered the position of the dimension representing member may be correspondingly altered by pivoting about said pivot point response to movement of the locating member by following said cam surface.

22. The printing apparatus of claim 21 wherein said cam surface comprises slots in said slidable bottom plates and said locating members on said pivotally mounted arms comprise locating pins in said slots.

23. The printing apparatus of claim 19 wherein said sheet support platform comprises two sheet support plates slidably engageable with each other, one of said support plates being pivotally mounted about its rear portion to said fixed side edge guide, the other of said support plates being pivotally mounted about its rear portion to said movable side edge guide whereby said sheet support plates provide a sheet support platform of different sizes corresponding to the position of said movable side edge guides.

24. The printing apparatus of claim 23 including means to upwardly bias the front portion of said sheet support plates.

25. The printing apparatus of claim 24 wherein said sheet support plate attached to said fixed side edge guide is upwardly biased by a spring anchored to the base of said cassette and said sheet support plate attached to said movable side edge guide is upwardly biased by a spring anchored to said slidable bottom plate attached to said movable side edge sheet guide.

26. The printing apparatus of claim 21 further including guide means for each of said slidable bottom plates.

27. The printing apparatus of claim 19 wherein said detector and control means on said apparatus are the same detector and control means to determine the size of sheets in a fixed size sheet cassette.

28. The printing apparatus of claim 19 wherein said detector means comprises a plurality of spaced individual detectors fixed to said apparatus which sends a signal to said control means when the presence of said width and length dimension representing members are detected by said individual detectors.

29. The printing apparatus of claim 19 including a display to display the sheet size of the sheets in the adjustable cassette as determined by said control means.

30. The printing apparatus of claim 18 wherein said sheet width and length dimension representing members are encoding members for a binary code, said encoding members representing a plurality of sheet widths and length dimension codes and being positioned by said positioning means to positions providing a unique binary code representing the sheet width and sheet length dimension of the stack of sheets on the platform, said binary code being detectable by said detector means and decoded by said control means to determine the length and width dimensions of a copy sheet in said cassette.

31. The printing apparatus of claim 30 wherein said means to position said sheet width and length dimension representing members comprises a pair of side edge sheet guides in opposed relationship to each other, at least one of said side edge sheet guides being movable relative to the other side edge sheet guide, a movable rear edge sheet guide, said at least one movable side and rear edge guides being adjustable to accommodate stacks of sheets of a plurality of width and length dimensions and means automatically responsive to movement of said at least one movable side and rear edge guides respectively to move said sheet width and length representing members to positions respectively representing a sheet width and a sheet length dimension.

32. The printing apparatus of claim 30 wherein said sheet length and sheet width dimension representing members comprise pivotally mounted arms one end of which extends toward the front of said cassette for detection by said detector means on said apparatus.

33. The printing apparatus of claim 32 wherein said sheet length and sheet width dimension representing arms pivot about the same fixed point.

34. The printing apparatus of claim 33 wherein said means automatically responsive comprises slidable bottom plates fixedly attached to each of said at least one movable side edge sheet guide and said movable rear edge sheet guide, each said bottom plate having a cam surface, each of said pivotally mounted arms having a locating member attached thereto spaced from said fixed pivot point in cooperative association with said cam surface whereby when the position of each of said movable guides is altered the position of the dimension representing member may be correspondingly altered by pivoting about said pivot point in response to movement of the locating member by following said cam surface.

35. The printing apparatus of claim 34 wherein said cam surfaces comprises slots in said slidable bottom plates and said locating members on said pivotally mounted arms comprise locating pins in said slots.

* * * * *